US009765588B2

(12) United States Patent
Mansukh et al.

(10) Patent No.: US 9,765,588 B2
(45) Date of Patent: Sep. 19, 2017

(54) HIGH STRENGTH INLAY TO IMPROVE LOCK-DOWN CAPACITY IN A WELLHEAD

(71) Applicant: Vetco Gray Inc., Houston, TX (US)

(72) Inventors: Mayur Mansukh, Houston, TX (US); Aniruddha D. Gadre, Houston, TX (US); David Lawrence Ford, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 242 days.

(21) Appl. No.: 14/522,126

(22) Filed: Oct. 23, 2014

(65) Prior Publication Data

US 2015/0114667 A1 Apr. 30, 2015

Related U.S. Application Data

(60) Provisional application No. 61/896,408, filed on Oct. 28, 2013.

(51) Int. Cl.
*E21B 33/04* (2006.01)

(52) U.S. Cl.
CPC ..... *E21B 33/04* (2013.01)

(58) Field of Classification Search
CPC ..... E21B 33/04; E21B 33/043
See application file for complete search history.

(56) References Cited

U.S. PATENT DOCUMENTS 3,086,590 A * 4/1963 Jackson, Jr. ..... E21B 33/035 166/348
4,577,686 A * 3/1986 Milberger ..... E21B 33/043 166/208
4,919,460 A * 4/1990 Milberger ..... E21B 33/043 166/208
5,067,734 A 11/1991 Boehm, Jr.
6,386,291 B1 * 5/2002 Short ..... E21B 33/0355 166/285
8,245,776 B2 8/2012 Gette et al.
2005/0252653 A1 * 11/2005 Vanderford ..... E21B 33/04 166/75.14
2010/0126736 A1 5/2010 Ellis et al.
(Continued)

FOREIGN PATENT DOCUMENTS

GB 2435488 A 8/2007

OTHER PUBLICATIONS

International Search Report and Written Opinion issued in connection with corresponding PCT Application No. PCT/US2014/062522 on Jun. 23, 2015.

*Primary Examiner* — George Gray
(74) *Attorney, Agent, or Firm* — Hogan Lovells US LLP

(57) ABSTRACT

A wellhead assembly includes a wellhead housing having a bore and a locking profile including a gallery slot, and an annular notch. An inner wellhead assembly is selectively landed in the bore of the wellhead housing, the inner wellhead assembly having a lock ring with a lock ring profile that engages the locking profile. The engaging surface is a sloped downward facing surface at an axially upper end of the gallery slot. The annular notch has a notch engaging profile with a downward facing notch upper shoulder and an upward facing notch lower shoulder. The locking profile includes an inlay, the inlay being located on the notch upper shoulder and the engaging surface.

15 Claims, 2 Drawing Sheets

(56) References Cited

U.S. PATENT DOCUMENTS

| | | | | |
|---|---|---|---|---|
| 2010/0147533 | A1* | 6/2010 | Nelson | E21B 33/04<br>166/379 |
| 2011/0088893 | A1 | 4/2011 | Gette et al. | |

* cited by examiner

HIGH STRENGTH INLAY TO IMPROVE LOCK-DOWN CAPACITY IN A WELLHEAD

CROSS REFERENCE TO RELATED APPLICATION

This application claims priority to and the benefit of U.S. Provisional Application Ser. No. 61/896,408 filed Oct. 28, 2013, titled "High Strength Inconel Inlay To Improve Lock-Down Capacity In A Wellhead," the full disclosure of which is hereby incorporated herein by reference in its entirety for all purposes.

BACKGROUND

1. Field of Invention

This invention relates in general to high pressure wellheads for use in oil and gas wells, and in particular to an inlay to increase the lock-down capacity of high pressure wellheads.

2. Description of Prior Art

A subsea well that is capable of producing oil or gas typically has a conductor housing secured to a string of conductor pipe which extends some short depth into the well. A wellhead housing lands in the conductor housing and secures to an outer or first string of casing, which extends coaxially through the conductor to a deeper depth into the well. Depending on the particular conditions of the geological strata above the target zone (typically, either an oil or gas producing zone or a fluid injection zone), one or more additional casing strings will generally extend through the outer string of casing to increasing depths in the well until the well is cased to the final depth. Each string of casing is supported at the upper end by a casing hanger, which usually lands in and is supported by the wellhead.

Where multiple casing hangers are landed in the wellhead housing, they are generally stacked on one another in the wellhead housing. The lowest string of casing extends into the well to the final depth, this being the production casing. The strings of casing between the outer casing and the production casing are usually referred to as intermediate casing strings.

Between each casing hanger and the wellhead housing, a casing hanger packoff or annular seal assembly is set to isolate each annular space between strings of casing. The weight of the casing hanger and the casing hanging from the casing hanger can prevent upward movement of the casing hanger under some circumstances. A lockdown ring, however, is required to lock the casing hanger in place and can be used to lock the annular seal assembly to the wellhead housing when the casing hanger is subjected to high pressures. Those high pressures can cause the casing hanger to move axially upward. Expansion and contraction of the casing can also cause the annular seal to be compromised and cause leaking.

Lockdown rings can be energized by a wedge ring. The wedge ring can have a tapered surface that expands the lockdown ring radially outward into a locking profile of the wellhead housing. The wedge ring can itself be moved axially downward by the annular seal. Once the wedge ring energizes the lockdown ring, the wedge ring stays in place to maintain the radial position of the lockdown ring. The lockdown ring has a lock ring profile that engages surfaces of the locking profile. The engaging surfaces mate to resist the lockdown forces. In some current designs, the capacity of the lockdown ring is limited by the yield strength of the material used to form the wellhead housing.

SUMMARY OF THE DISCLOSURE

The methods and systems of the current disclosure provide a wellhead assembly with an increased lockdown capacity by providing a higher strength inlay along the load bearing surfaces of the locking profile of the wellhead housing. By having inlays, the strength of the locking profile of the wellhead housing is increased, the bearing capacity is increased, and the lockdown capacity is increased In an embodiment of this disclosure, a wellhead assembly includes a wellhead housing having bore and a locking profile. The locking profile includes a gallery slot and an annular notch. An inner wellhead assembly is selectively landed in the bore of the wellhead housing, the inner wellhead assembly having a lock ring with a lock ring profile that engages the locking profile. The gallery slot is defined by an enlarged inner diameter of the bore and has an engaging surface. The engaging surface is a sloped downward facing surface at an axially upper end of the gallery slot. The annular notch has a notch engaging profile with a notch upper shoulder and a notch lower shoulder. The notch upper shoulder is downward facing and the notch lower shoulder is upward facing. The locking profile includes an inlay, the inlay being located on the notch upper shoulder and the engaging surface.

In an alternate embodiment of the current disclosure, a wellhead assembly includes a wellhead housing having bore and a locking profile. The locking profile has a gallery slot, the gallery slot having an engaging surface that is sloped and downward facing. The locking profile also includes an annular notch that is axially spaced from the gallery slot and has a notch upper shoulder and a notch lower shoulder. The notch upper shoulder is downward facing and the notch lower shoulder is upward facing. A plurality of flow-by slots extend axially upward from the gallery slot and extend past the annular notch. The locking profile further includes a plurality of inlays that are located on at least a portion of the notch upper shoulder and a portion of the engaging surface, the inlays being separated by the flow-by slots. An inner wellhead assembly is selectively landed in the bore of the wellhead housing, the inner wellhead assembly having a lock ring with a lock ring profile that engages the locking profile along the plurality of inlays.

In yet another embodiment of the current disclosure, a method for completing a well with a wellhead assembly includes landing an inner wellhead assembly within a bore of a wellhead housing. The wellhead housing has a locking profile with a gallery slot and an annular notch. An inlay is located on an engaging surface of the gallery slot, and on a notch upper shoulder of the annular notch. The locking profile engages a lock ring of the inner wellhead assembly to secure the inner wellhead assembly to the wellhead housing.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE DISCLOSURE

Figure 1:
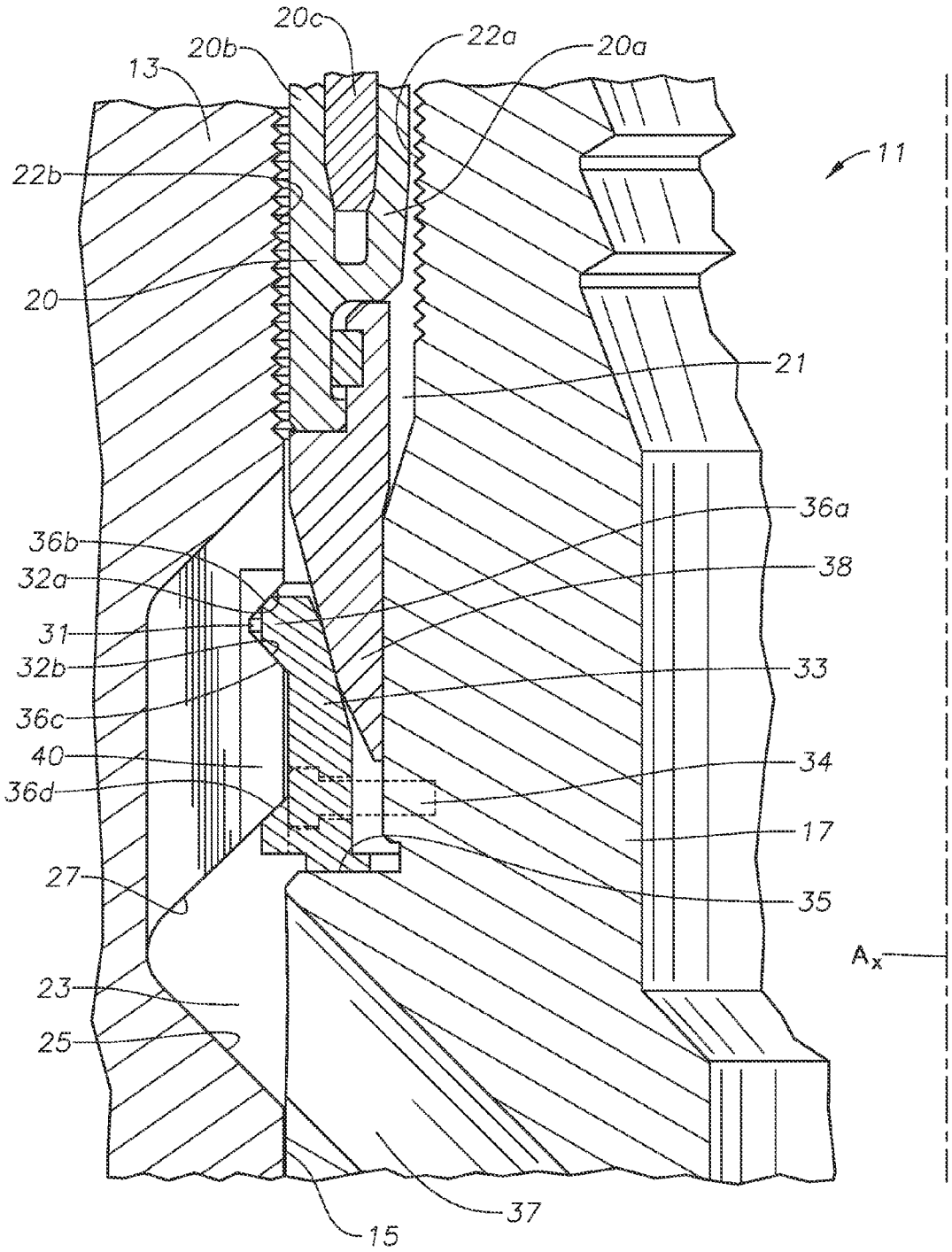
FIG. 1 is a section view of a wellhead assembly with inlays, in accordance with an embodiment of this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, in an example configuration of a wellhead assembly 11, wellhead assembly 11 includes a tubular wellhead member, such as wellhead housing 13 with a central axis Ax. Wellhead housing 13 can be a subsea wellhead located over a well (not shown) and also can be a high pressure tubular member having an exterior surface and bore 15. Wellhead housing 13 secures to a first string of casing, which extends through a conductor pipe to a depth into the well.

An inner wellhead assembly or casing hanger 17, such as an intermediate casing hanger or production casing hanger, can land within bore 15 and can be supported within bore 15 by a hanger support. The hanger support can be, for example, an annular load ring assembly, or an integral lower shoulder of bore 15. An annular seal assembly 20 seals annular cavity 21 which is defined between an outer diameter of casing hanger 17 and bore 15 of the wellhead housing 13. In alternate embodiments, the inner wellhead assembly can be, for example, an annular seal, or other wellhead component.

The outer diameter of casing hanger 17 can have hanger sealing surface 22*a* that can include a series of circumferentially extending hanger wickers. Bore 15 can have housing sealing surface 22*b* that include a series of circumferentially extending housing wickers. Annular seal assembly 20 can have an inner annular leg 20*a* and an outer annular leg 20*b*, which are joined by a base to form a generally U shape in cross section. Legs 20*a*, 20*b* are forced radially apart by energizing ring 20*c* so that inner annular leg 20*a* engages hanger wickers of hanger sealing surface 22*a* and annular outer leg 20*b* engages housing wickers of housing sealing surface 22*b*, to assist in forming and maintaining the seal between the outer diameter of casing hanger 17 and bore 15. In other embodiments sealing surfaces 22*a*, 22*b* can be smooth, or can have an alternate profile to form appropriate sealing surfaces for annular seal assembly 20.

Figure 3:
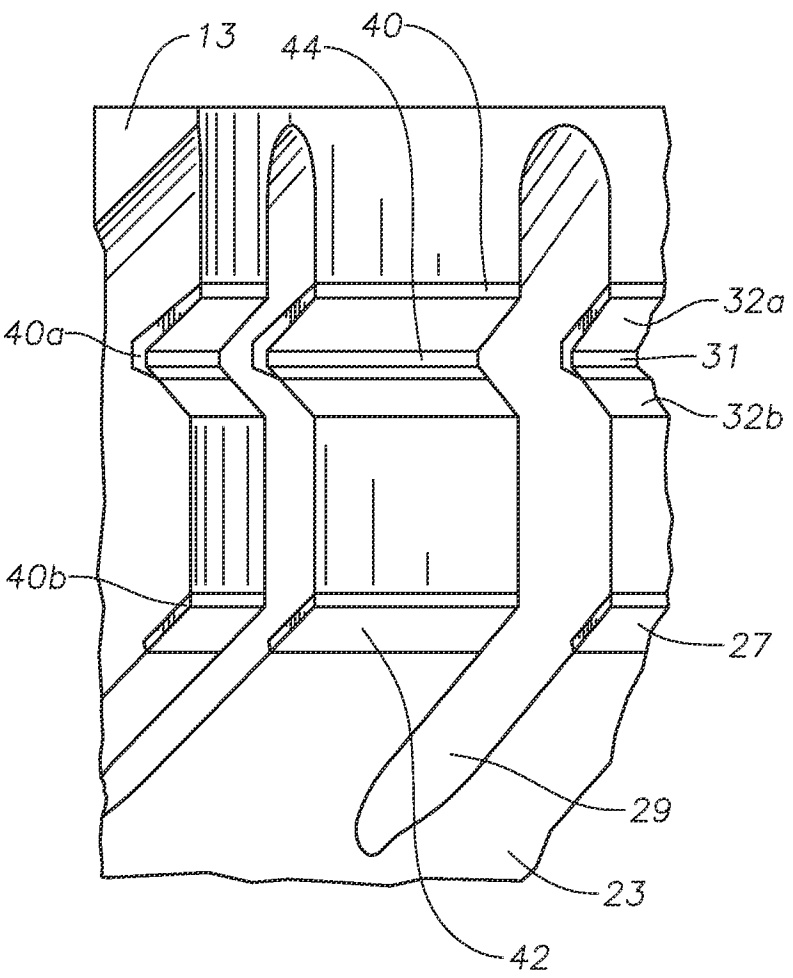
FIG. 3 is a detail section view of a wellhead housing with inlays, in accordance with an embodiment of this disclosure.
Figure 2:
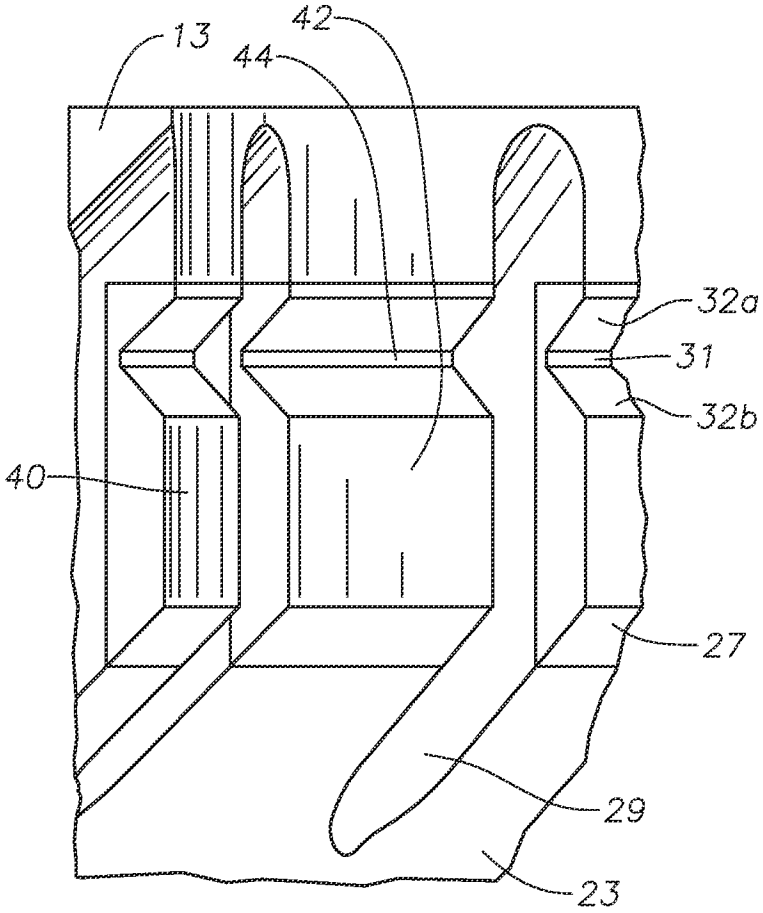
FIG. 2 is a detail section view of a wellhead housing with inlays, in accordance with an embodiment of this disclosure.

Looking at FIGS. 1-3, wellhead housing 13 includes a gallery slot 23. Wellhead housing 13 can have a single gallery slot 23, or a plurality gallery slots 23 spaced axially apart along bore 15. Gallery slot 23 is an annular recess defined by an enlarged inner diameter of bore 15. Gallery slot 23 has a sloped upward facing surface 25 and an engaging surface 27. Engaging surface 27 is a sloped downward facing surface located at an axially upper end of gallery slot 23. An outer wall that is generally parallel to axis Ax connects sloped upward facing surface 25 and engaging surface 27. Gallery slot 23 can be formed by rotating a tool 360 degrees around bore 15 to carve material out of bore 15 and create sloped upward facing surface 25 and engaging surface 27.

Wellhead housing 13 also includes a plurality of flow-by slots 29 (FIGS. 2-3). Each flow-by slot 29 extends axially upward from gallery slot 23. Flow-by slots 29 can extend axially upward to a region of bore 15 proximate to housing sealing surface 22*b*. Flow-by slots 29 are generally axially extending grooves in bore 15 and can be formed by removing material from the inner diameter of bore 15 with a tool. Casing hanger 17 has flow-by passage 37 (FIG. 1). Flow-by passage 37 is a passageway defined within a sidewall of casing hanger 17 and can have a circular cross section. Casing hanger 17 can include more than one flow-by passage 37, with flow-by passages 37 being spaced around a diameter of the sidewall of casing hanger 17. Flow-by passage 37 is in fluid communication with gallery slot 23 and provides a conduit for fluids within bore 15 to flow upwards or downwards past casing hanger 17.

Wellhead housing 13 further includes annular notch 31. Annular notch 31 is a groove in bore 15. Annular notch 31 can be formed by rotating a tool 360 degrees around bore 15 to carve material out of bore 15. Annular notch 31 has an engaging profile including notch upper shoulder 32*a* and notch lower shoulder 32*b*. Notch upper shoulder 32*a* is sloped and downward facing and notch lower shoulder 32*b* is sloped and upward facing. Annular notch 31 can have a generally V shape in cross section and have a radial depth that is less than a radial depth of flow-by slots 29. Flow-by slots 29 can extend axially upwards past annular notch 31, intersecting annular notch 31.

Annular notch 31 is spaced axially apart from engaging surface 27 of gallery slot 23. Gallery slot 23 and annular notch 31 together define a locking profile for accepting lock ring 33. In the example embodiment of FIG. 1, lock ring 33 secures casing hanger 17 to wellhead housing 13.

Casing hanger 17 has an annular upward-facing shoulder 35 on an outer diameter of casing hanger 17. Lock ring 33 can be retained to casing hanger 17 by a retainer member 34 so that lock ring 33 is carried with casing hanger 17. Retainer member 34 can be secured to casing hanger 17 and extend through a radially extending opening in lock ring 33 so that lock ring 33 can move radially relative to casing hanger 17 along retainer member 34, but lock ring 33 is restricted from axial movement relative to casing hanger 17.

Lock ring 33 can be radially expandable and can rest on annular upward-facing shoulder 35 in a contracted position during installation, with an inner diameter of lock ring 33 proximate to an outer diameter surface of casing hanger 17. In an engaged position, lock ring 33 expands radially outward so that lock ring profile 36 on an outer diameter of lock ring 33 engages engaging surface 27 and annular notch 31, and continues to engage annular upward-facing shoulder 35, so that casing hanger 17 cannot move axially upward relative to wellhead housing 13. Lock ring 33 additionally supports annular seal assembly 20 while annular seal assembly 20 is being energized to seal between the outer diameter of casing hanger 17 and bore 15.

Lock ring profile 36 can have upper wedge 36*a*. Upper wedge 36*a* is located at an axially upper end of lock ring 33 and protrudes radially outward from a main body of lock ring 33. Upper wedge 36*a* has an upper wedge surface 36*b* for engaging notch upper shoulder 32*a*. Upper wedge 36*a* also includes a lower wedge surface 36*c* for engaging notch lower shoulder 32*b*. Lock ring profile 36 also has a lower profile 36*d* for mating with engaging surface 27.

Lock ring 33 can be pushed into engagement with the locking profile of wellhead housing 13 and can be retained in engagement by wedge ring 38. Wedge ring 38 is a lower nose portion of annular seal assembly 20 and is connected to, and extends axially downward from, annular seal assembly 20. Wedge ring 38 is generally wedged shaped, such as generally triangular in cross section, so that axially downward movement of wedge ring 38 causes a sloped surface of wedge ring 38 to mate with a sloped inner diameter surface of lock ring 33, pushing lock ring 33 radially outward and into engagement with the locking profile of wellhead housing 13.

The locking profile of wellhead housing 13 includes inlay 40. Inlay 40 is formed of a material with a hardness and tensile yield strength that is greater than the hardness and tensile yield strength of the material forming wellhead housing 13. As an example, wellhead housing 13 can have a tensile yield strength of 55 ksi to 80 ksi, and in a preferred embodiment, a tensile yield strength of 60 ksi. Inlay 40 can have a tensile yield strength of 110 ksi to 160 ksi and in a preferred embodiment, can have a tensile yield strength of at least 120 ksi. Inlay 40 can have a tensile yield strength that is two to three times the tensile yield strength of the material forming wellhead housing 13. The greater the relative yield strength of inlay 40 compared to the tensile yield strength of the material forming wellhead housing 13, the less thick inlay 40 will have to be in a direction normal to the surface of inlay 40 against which lock ring 33 will act.

Inlay 40 can be formed from, as an example, a nickel alloy and in a preferred embodiment, can be formed from a nickel chromium alloy. Inlay 40 can be formed of a material that has, for example, a nickel content of 43.0 wt % to 60.0 wt % and in a preferred embodiment, a nickel content of 58.5 wt %. Inlay 40 can be formed of a material that has, for example, a chromium content of 18.0 wt % to 21.0 wt % and in a preferred embodiment, a chromium content of 20.8 wt %. Inlay 40 can be formed of a material that also includes one or more of iron, molybdenum, niobium, titanium, and aluminum.

Inlay 40 can be located on notch upper shoulder 32*a* and engaging surface 27. Notch upper shoulder 32*a* and engaging surface 27 will be subjected to higher forces from lock ring 33 than other regions of the locking profile of wellhead housing 13 as the interaction between the locking profile and the lock ring prevent casing hanger 17 from moving axially upward relative to wellhead housing 13. In alternate embodiments, inlay 40 can also be located on notch lower shoulder 32*b*. In the example embodiment of FIGS. 1-2, inlay 40 is located on bore 15 in the entire region between gallery slot 23 and annular notch 31. In such an example, inlay 40 extends as a single piece from a location axially above annular notch 31 to a region of engaging surface 27. The lower edge of inlay 40 is a tapered surface that is flush with engaging surface 27. A radial depth of inlay 40, measured radially outward from a surface of bore 15, is less than the radial depth of flow-by slots 29. As such inlay 40 can include a plurality of separate inlay segments 42 spaced around an inner circumference of wellhead housing 13 that extend a short circumferential distance and are separated by flow-by slots 29. The radial depth of inlay 40 is greater than a radial depth of annular notch 31 so that inlay 40 is located over base 44 of annular notch 31. Base 44 is an axially extending surface between notch upper shoulder 32*a* and notch lower shoulder 32*b*.

In the alternate example embodiment of FIG. 3, inlay 40 can include an upper inlay 40*a* and a lower inlay 40*b*. Upper inlay 40*a* can be located on notch upper shoulder 32*a* and lower inlay 40*b* can be located on engaging surface 27. Upper inlay 40*a* can extend to a uppermost portion of notch lower shoulder 32*b*. Lower inlay 40*b* can extend along a portion of engaging surface 27. In such an embodiment, each inlay segment 42 includes an upper inlay 40*a* and a lower inlay 40*b*, which are separate inlay members.

Each component of inlay 40, such as separate inlay segments 42, upper inlay 40*a*, and lower inlay 40*b*, can be formed individually and secured to bore 15, which could already include flow-by slots 29 and gallery slot 23. Alternately, inlay 40 can be secured to wellhead housing 13 before one or more of annular notch 31, flow-by slots 29, and gallery slot 23 are formed. Inlay 40 is not a spray-on or other type of surface coating, but instead a separately formed element that is added to wellhead housing 13. Inlay 40 can be secured to wellhead housing 13 by, for example, welding, metal bonding, cladding, the use of adhesive, or by molding inlay 40 in place.

In an example of operation, casing hanger 17 can be landed in bore 15 of wellhead housing 13, and the casing can be cemented. During the cementing procedure, drilling mud, cement, and other well fluids can be returned axially upwards past casing hanger 17 by way of flow-by passage 37 to gallery slot 23 and flow-by slots 29 to annular cavity 21. During the landing of casing hanger 17 and throughout the cementing procedure, lock ring 33 can be in the contracted position, with an inner diameter of lock ring 33 proximate to an outer diameter surface of casing hanger 17. Also during the landing of casing hanger 17 and throughout the cementing procedure, annular seal assembly 20 will be located so that legs 20*a*, 20*b* are located axially above sealing surfaces 22*a*, 22*b*.

A running tool is then used to push energizing ring 20*c* axially downward so that wedge ring 38 moves lock ring 33 to the engaged position, expanding lock ring 33 radially outward so that lock ring profile 36 on an outer diameter of lock ring 33 engages engaging surface 27 and annular notch 31 (FIG. 1). Further downward movement of energizing ring 20*c* forces energizing ring 20*c* further between legs 20*a*, 20*b* so that inner annular leg 20*a* engages hanger wickers of hanger sealing surface 22*a* and annular outer leg 20*b* engages housing wickers of housing sealing surface 22*b*, so that legs 20*a*, 20*b* are in permanent sealing engagement with the wickers of sealing surfaces 22*a*, 22*b*.

In such a position, lock ring 33 engages inlay 40, preventing upward movement of casing hanger 17 relative to wellhead housing 13, so that the sealing integrity of annular seal assembly 20 can be maintained.

The terms "vertical", "horizontal", "upward", "downward", "above", and "below" and similar spatial relation terminology are used herein only for convenience because elements of the current disclosure may be installed in various relative positions.

The system and method described herein, therefore, are well adapted to carry out the objects and attain the ends and advantages mentioned, as well as others inherent therein. While a presently preferred embodiment of the system and method has been given for purposes of disclosure, numerous changes exist in the details of procedures for accomplishing the desired results. These and other similar modifications will readily suggest themselves to those skilled in the art, and are intended to be encompassed within the spirit of the system and method disclosed herein and the scope of the appended claims.

What is claimed is:

1. A wellhead assembly comprising:

a wellhead housing having a bore and a locking profile including a gallery slot and an annular notch; and an inner wellhead assembly selectively landed in the bore of the wellhead housing, the inner wellhead assembly having a lock ring with a lock ring profile that engages the locking profile; wherein the gallery slot is defined by an enlarged inner diameter of the bore;

the gallery slot has an engaging surface, the engaging surface being a sloped downward facing surface at an axially upper end of the gallery slot;

the annular notch has a notch engaging profile with a notch upper shoulder and a notch lower shoulder, the notch upper shoulder being downward facing and the notch lower shoulder being upward facing, wherein the lock ring comprises surfaces that engage the notch upper shoulder, the notch lower shoulder, and the engaging surface; and the locking profile includes an inlay, the inlay being located on the notch upper shoulder and the engaging surface.

2. The wellhead assembly of claim 1, wherein the inlay is further located on the notch lower shoulder.

3. The wellhead assembly of claim 1, wherein the inlay is further located on the bore in a region between the gallery slot and the annular notch.

4. The wellhead assembly of claim 1, wherein the wellhead housing has a plurality of flow-by slots, each of the flow-by slots extending axially upward from the gallery slot and extending past the annular notch.

5. The wellhead assembly of claim 4, wherein the inlay has a radial depth that is less than the radial depth of the flow-by slots.

6. The wellhead assembly of claim 4, wherein the inlay includes a plurality of separate inlay segments spaced around an inner circumference of the wellhead housing and separated by the flow-by slots.

7. The wellhead assembly of claim 1, wherein the inlay has a radial depth that is greater than a radial depth of the annular notch.

8. A wellhead assembly comprising:

a wellhead housing having a bore and a locking profile, the locking profile including:

a gallery slot, the gallery slot having an engaging surface that is sloped and downward facing;

an annular notch that is axially spaced from the gallery slot and has a notch upper shoulder and a notch lower shoulder, the notch upper shoulder being downward facing and the notch lower shoulder being upward facing; and a plurality of inlays, each of the inlays being located on at least one of a portion of the notch upper shoulder and a portion of the engaging surface;

a plurality of flow-by slots located on the bore, each of the flow-by slots extending axially upward from the gallery slot and extending past the annular notch, wherein the plurality of inlays are separated by the flow-by slots; and an inner wellhead assembly selectively landed in the bore of the wellhead housing, the inner wellhead assembly having a lock ring with a lock ring profile, wherein the lock ring profile includes surfaces that engage the notch lower shoulder, and the notch upper shoulder and the engaging surface along the plurality of inlays.

9. The wellhead assembly of claim 8, wherein each of the inlays has a radial depth that is less than a radial depth of the flow-by slots and greater than a radial depth of the annular notch.

10. The wellhead assembly of claim 8, further comprising an annular seal assembly with a wedge ring, the wedge ring selectively pushing the lock ring profile into engagement with the locking profile.

11. A method for completing a well with a wellhead assembly, the method comprising:

landing an inner wellhead assembly within a bore of a wellhead housing, the wellhead housing having a locking profile with a gallery slot, an annular notch having a notch upper shoulder and a notch lower shoulder, and an inlay located on an engaging surface of the gallery slot, and on the notch upper shoulder; and engaging the locking profile with a lock ring of the inner wellhead assembly to secure the inner wellhead assembly to the wellhead housing, wherein the lock ring comprises surfaces that engage the notch lower shoulder, and the notch upper shoulder and the engaging surface via the inlays.

12. The method of claim 11, wherein the step of engaging the locking profile with the lock ring includes engaging at least a portion of the inlay with the lock ring.

13. The method of claim 11, wherein the step of engaging the locking profile with the lock ring includes engaging the notch upper shoulder and the engaging surface with the lock ring.

14. The method of claim 11, wherein the engaging surface is sloped and downward facing and located at an axially upper end of the gallery slot, the notch upper shoulder is downward facing, and the lock ring has a lock ring profile, and wherein the step of engaging the locking profile with the lock ring includes engaging the engaging surface and the notch upper shoulder with the lock ring profile.

15. The method of claim 11, wherein the inner wellhead assembly further comprises a wedge ring and the step of engaging the locking profile with the lock ring of the inner wellhead assembly includes pushing the lock ring into engagement with the locking profile with the wedge ring.

* * * * *